US008659444B2

(12) United States Patent
Svensson

(10) Patent No.: US 8,659,444 B2
(45) Date of Patent: Feb. 25, 2014

(54) COMMUNICATION BETWEEN STATIONS AND VEHICLES

(75) Inventor: Bengt Svensson, Jonkoping (SE)

(73) Assignee: Kapsch TrafficCom AB (SE)

( * ) Notice: Subject to any disclaimer, the term of this patent is extended or adjusted under 35 U.S.C. 154(b) by 46 days.

(21) Appl. No.: 13/180,347

(22) Filed: Jul. 11, 2011

(65) Prior Publication Data

US 2012/0242504 A1 Sep. 27, 2012

(30) Foreign Application Priority Data

Jul. 13, 2010 (EP) ..... 10169441

(51) Int. Cl.
*G08G 1/09* (2006.01)

(52) U.S. Cl.
USPC ..... 340/905; 340/995.13

(58) Field of Classification Search
USPC ..... 340/905, 928, 933, 991, 902, 995.13; 235/384, 375, 383, 380; 364/401, 436
See application file for complete search history.

(56) References Cited

U.S. PATENT DOCUMENTS 6,344,804 B1 2/2002 Koga
6,756,915 B2 * 6/2004 Choi ..... 340/928
7,969,325 B2 * 6/2011 Hamilton et al. ..... 340/928
8,275,307 B2 * 9/2012 Doyle, III ..... 455/3.06
2009/0067449 A1 3/2009 Tian

OTHER PUBLICATIONS

"Broadcasting Communication Systems", *Concise Encyclopedia of Traffic & Transportation Systems, 2nd Edition*, Pergamon Press, The Netherlands, (1999), 4 pgs.
"European Application Serial No. 10169441.2, European Search Report mailed Nov. 24, 2010", 7 pgs.

* cited by examiner

*Primary Examiner* — Toan N Pham
(74) *Attorney, Agent, or Firm* — Schwegman Lundberg & Woessner, P.A.

(57) ABSTRACT

An On Board Equipment (OBE) suitable for mounting on a vehicle comprises an OBE antenna connected to an OBE transmit/receive unit. The OBE antenna is arranged to receive a signal from a station via a first wireless communication link. The signal comprises at least one traffic information message from the station. The OBE is arranged to convert the traffic information message for transfer to an audio output through at least one speaker in an existing audio system of the vehicle wherein said transfer of the traffic information message to the existing audio system is arranged to be performed via a second wireless communication link. The traffic information message is arranged to be picked up by standard receiving means of the existing audio system and to be delivered as a voice message on said speakers through a prioritized channel of the existing audio system.

16 Claims, 3 Drawing Sheets

COMMUNICATION BETWEEN STATIONS AND VEHICLES

RELATED APPLICATION

This application claims the benefit of priority under 35 U.S.C. Section 119, to European Patent Application Serial No. EP10169441.2, filed Jul. 13, 2010; which application is incorporated herein by reference in its entirety.

TECHNICAL HELD

The present invention relates to the field of transfer of messages from a station to an equipment located in a vehicle.

BACKGROUND

There is often a need to transfer messages from a traffic toll station to vehicles passing the toll station. Many vehicles are equipped with so called transponders able to communicate with the toll station. The transponder includes a transmitter and a receiver able to receive a message from the toll station and transmit information to the toll station. The communication can be DSRC-based (Dedicated Short Range Communication) where various standards exists, e.g. the CEN-standard (European Committee for Standardization) in the 5.8 GHz band. The transponder can be equipped with a configurable buzzer that can convey coded messages to the vehicle such as e.g.:

OK

Not OK

Contact operator.

The message can be coded through a series of beeps or different tones.

The transponder can send an identification message to the to station thus allowing Electronic Fee Collection as the car is passing the to station without stopping.

The buzzers in transponders of today are generally simple piezo-electric buzzers. These buzzers do not have a sufficient sound quality for a voice message. To solve this problem more expensive buzzers have to be installed in the transponders. Even if high quality buzzers are installed in the transponders, a voice message from the transponder may be difficult to hear due to other sound sources in the vehicle as e.g. radio, TV or mobile phone.

FIG. 1 schematically shows a prior art solution of a vehicle mounted transponder 101 with an antenna 102 receiving a message from a toll station and outputting a coded message via a buzzer 103. The transponder is also capable of transmitting an identification message back to the toll station.

U.S. Pat. No. 6,344,804 B1 describes how a message from a toll station can be transferred to a vehicle unit in a vehicle and transferred to a voice message to be sent to an audio system in the vehicle. The transfer from the vehicle unit to the audio system is not described in detail. A transfer of a coded message to a synthesized voice signal is performed in the vehicle unit. When such a synthesized message is generated a switching unit is outputting the synthesized message to the audio system of the vehicle. This is a relatively complicated solution where modifications to the audio system have to be implemented.

There is thus a need for an improved solution for transferring messages from a toll station to a vehicle.

SUMMARY

The object of the invention is to reduce at least some of the mentioned deficiencies with the prior art solutions and to provide:

an On Board Equipment for mounting on a vehicle, a method for transferring a message from a station to a vehicle using the On Board Equipment and a traffic information system comprising the OBE to solve the problem to achieve an improved solution for transferring messages from a station, such as a toll station, to a vehicle.

The object is achieved by providing an On Board Equipment, OBE, suitable for mounting on a vehicle. The OBE comprises an OBE antenna connected to an OBE transmit/receive unit. The OBE antenna is arranged to receive a signal from a station via a first wireless communication link. The signal comprises at least one traffic information message from the station. The OBE is arranged to convert the traffic information message for transfer to an audio output through at least one speaker in an existing audio system of the vehicle wherein said transfer of the traffic information message to the existing audio system is arranged to be performed via a second wireless communication link. The traffic information message is arranged to be picked up by standard receiving means of the existing audio system and to be delivered as a voice message on said speakers through a prioritized channel of the existing audio system.

The object is further achieved by a method for transferring a message from a station to a vehicle using an On Board Equipment, OBE, mounted on the vehicle. The OBE has an OBE antenna connected to an OBE transmit/receive unit where the method comprises the steps of:

using the OBE antenna for receiving a signal from a station via a first wireless communication link, the signal comprising at least one traffic information message from the station, using the OBE to convert said traffic information message for transfer to an audio output through at least one speaker in an existing audio system of the vehicle, wherein the method further comprises the steps of:

performing said transfer of the traffic information message to the existing audio system via a second wireless communication link, picking up said traffic information message by standard receiving means of the existing audio system and delivering said traffic information message as a voice message on said speakers through a prioritized channel of the existing audio system.

The object is still further achieved by a traffic information system wherein the traffic information system comprises:

a station comprising a transmit/receive unit an OBE, a first wireless communication link between the station and the OBE and a second wireless communication link, between the OBE and the existing audio system located in the vehicle, arranged for transfer of the traffic information message to the existing audio system.

Further advantages are achieved if the invention is also given one or several characteristics according to the dependent claims not mentioned above. This will be further explained below.

DETAILED DESCRIPTION

The invention will now be described with reference to the enclosed drawings.

Figure 1:
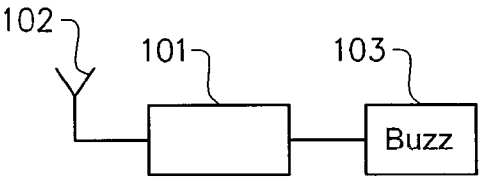
FIG. 1 PRIOR ART
FIG. 1 schematically shows a prior art solution of a vehicle mounted transponder.

FIG. 1 has already been described in the Background part above.

Figure 2:
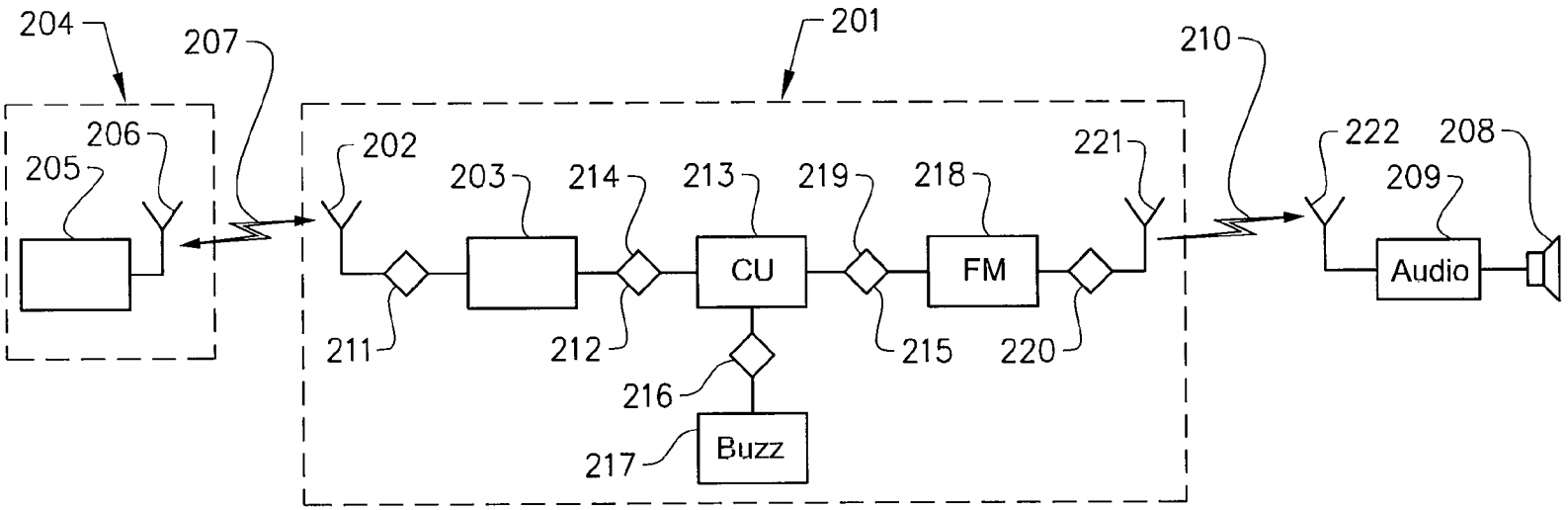
FIG. 2 schematically shows a block diagram of an example of a traffic information system according to the invention with an example of an On Board Equipment according to the invention.

FIG. 2 schematically shows a block diagram of an example of a traffic information system 200 with an example of an On Board Equipment, OBE, 201 according to the invention.

The OBE, suitable for mounting on a vehicle, comprises an OBE antenna 202 connected to an OBE transmit/receive unit 203, the OBE antenna being arranged to receive an RF signal from a station 204 via a transmit/receive unit 205, a transmit/receive antenna 206 and a first communication link 207.

The RF signal comprises at least one traffic information message from the station. The OBE is arranged to convert the traffic information message for transfer to an audio output through at least one speaker 208 in an existing audio system 209 of the vehicle. Said transfer of the traffic information message to the existing audio system is arranged to be performed via a second communication link 210 where the traffic information message is arranged to be picked up by standard receiving means of the existing audio system and to be delivered as a voice message on said speakers through a prioritized channel of the existing audio system.

The existing audio system, mounted in the vehicle, can be a standard audio product comprising e.g. an FM radio receiver and CD player connected to a speaker system as will be explained. The existing audio system may also include a Bluetooth receiver or other short range receiving system.

The station 204 is typically a toll station for electronic fee collection. The invention is exemplified with the station 204 being a toll station but the invention is also applicable to other stations. Some examples of other types of stations are also described.

The OBE transmit/receive unit 203 comprises an OBE antenna terminal 211 connected to the OBE antenna 202 and an OBE output terminal 212. An identification message, comprising an identification of the vehicle, is arranged to be transmitted from the OBE 201 via the first communication link 207 to the toll station 204.

In one example of the invention the first communication link 207 is a Dedicated Short Range Communication, DSRC link with a DSRC transmit/receive unit as the transmit/receive unit at the toll station 204 and with a further DSRC transmit/receive unit as the OBE transmit/receive unit 203, the DSRC transmit/receive unit at the OBE being arranged to receive the RF-signal from the OBE-antenna 202 at the OBE antenna terminal 211.

The identification message is preferably arranged to be transmitted from the OBE antenna 202 via the first communication link 207 to the to station 204 when the OBE-equipped vehicle passes the station 204. The identification message is in one example of the invention generated in the OBE, after a request for identification message has been sent from the station to the OBE, by conventional means used for transponder functions and well known to the skilled person. In this example it means that the request for identification is sent when the OBE-equipped vehicle passes the station and is within the reach of the first communication link. The first communication link can also be any other suitable wireless communication link, such as e.g. a short range infrared link or Bluetooth link.

The identification message can use the OBE antenna 202 for transmitting the message to the toll station. The switching of the OBE antenna between receive and transmit mode can be arranged with any conventional solution, well known to the skilled person, using e.g. a duplexer or circulator. It is also possible to have a separate antenna for transmitting the identification message to the toll station. In this case there is no need for a duplexer or circulator.

As mentioned above in association with the description of FIG. 2, the station is typically a stationary toll station. The position of the vehicle when the identification message is sent from the vehicle to the station is henceforth defined as a gantry position, a virtual gantry position or a position at a predetermined point of time. In the example of FIG. 2, when a DSRC link is used as the first communication link, the gantry position coincides with the position of the station. A gantry is typically a gate at the toll station where information is exchanged between the vehicle and toll station when the vehicle is passing in the vicinity of the gantry. In this example the position of the vehicle is thus substantially the same as the position of the toll station and the gantry and the identification message is thus sent when the OBE-equipped vehicle passes the station. There are however also examples of the invention where the gantry position is not the same as the position of the station. In these examples of the invention there is one position for the station and separate positions for one or several virtual gantries as will be explained in association with FIG. 3 and in these examples the position of the vehicle has to be defined by using a positioning system such as GPS (Global Positioning System).

Figure 3:
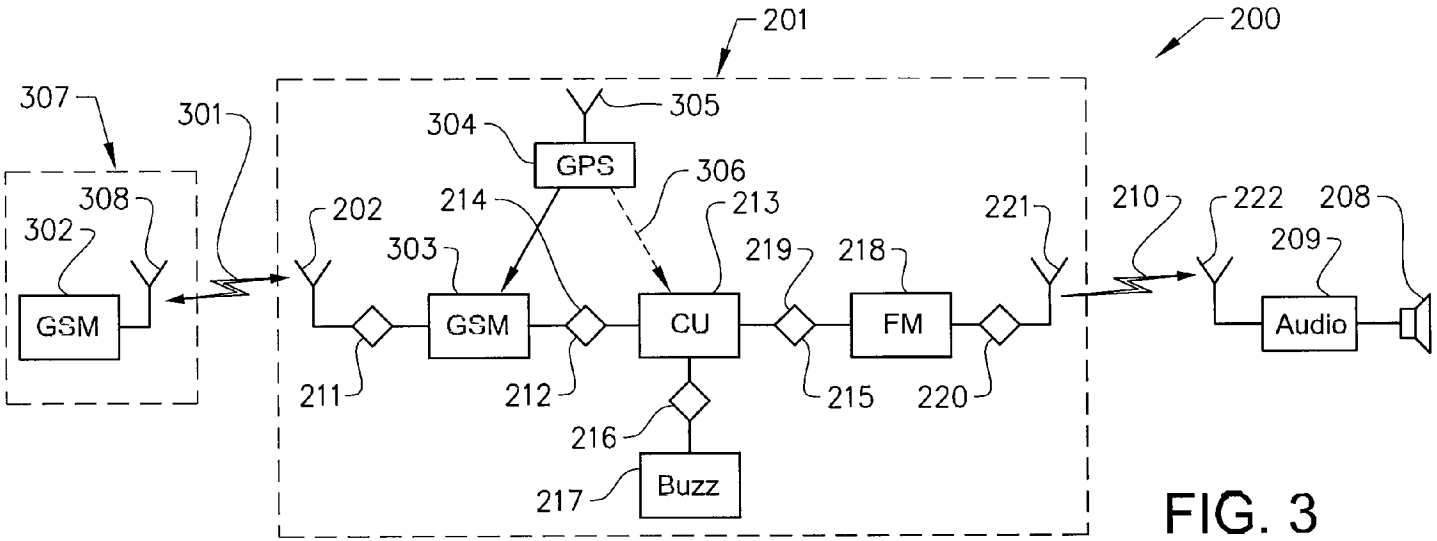
FIG. 3 schematically shows a block diagram of a further example of a traffic information system according to the invention with a further example of an On Board Equipment according to the invention.

In a traffic information system using virtual gantries, each virtual gantry is defined as being located at a certain predetermined geographical position. These predetermined virtual gantry positions are normally stored in the OBE, preferably in the CU. When the vehicle has reached the predetermined virtual gantry positions, an identification message is transmitted via the first communication link. The information of positions of the virtual gantries can also be sent to the OBE via the first communication link. This facility for transfer of positions of virtual gantries via the first communication link is primarily used for updating of these positions. An example of the invention using virtual gantries is illustrated in FIG. 3, where the first communication link 207 is a cellular communication link 301, e.g. a GSM link (Global System for Mobile communication) as shown in FIG. 3, with a cellular transmit/receive unit such as a GSM transmit/receive unit 302 at the station working as the transmit/receive unit 205 and the OBE transmit/receive unit 203 comprises a cellular transmit/receive unit 303, in this example a GSM transmit/receive unit, arranged to receive the RF-signal from the OBE antenna 202 at the OBE antenna terminal 211. The station 204 is in this example a cellular base station 307 for GSM with a cellular antenna 308. The cellular transmit/receive unit at the station is suitable for a base station and the transmit/receive unit at the OBE is suitable for a mobile device. The OBE 201 further comprises a GPS receiver 304 with its GPS antenna 305. The OBE is arranged to transmit the identification message, optionally including the current position of the vehicle according to the GPS, via the first wireless communication link to the station 307 when a predetermined virtual gantry position is reached by the OBE-equipped vehicle. The function of comparing actual position of the vehicle with the predetermined virtual gantry positions is arranged to be performed in the OBE, preferably in a Control Unit, CU, 213. The GPS receiver with its antenna can be a separate unit, as shown in FIG. 3, communicating with the cellular transmit/receive unit 303 or with the CU 213 as indicated with the dotted arrow 306. The GPS receiver with antenna can also be integrated in the GSM transmit/receive unit 303 or the CU 213.

The station can, over and above a transmit/receive unit with associated antenna, e.g. also comprise means arranged for generating e.g. traffic information messages, requests for identification and instruction messages to be transmitted via the transmit/receive unit at the station and the first communication link and means arranged for processing, storing and analyzing information received via the first communication link. These means are often colocated with the station when the station is configured as a toll station with a colocated gantry. In other applications, e.g. with the station configured for using a cellular communication link as the first communication link, these means can be located elsewhere, e.g. at a main station, and be connected to the station with a further communication link.

By using virtual gantries it will be possible to charge a vehicle depending on which virtual gantry positions that have been passed without requiring physical gantries. The calculation of the distance traveled and the fee can preferably be performed at the station or the main station based on position reports via the identification message. However the calculation of the distance traveled and the corresponding fee can also be calculated in the OBE, e.g. in the CU, and sent to the station or the main station together with the identification message. The identification message thus includes the identification of the vehicle and optionally additional information comprising its current position and/or distance traveled, the distance traveled optionally being converted to a fee. When a gantry position is reached, the identification message is generated in the OBE by conventional means used for transponder functions and well known to the skilled person as described earlier. The identification message can however also be generated in the OBE automatically when a virtual gantry position is reached. The first communication link can be any suitable communication link based on e.g. a cellular system such as GSM, including newer versions as GPRS (General Packet Radio Service), EDGE (Enhanced data Rates for GSM Evolution), HSCSD (High Speed Circuit Switched Data) or a 3G (third generation) or an LTE (Long Term Evolution) or a 4G system. In other respects the example of FIG. 3 corresponds to the example of the invention illustrated in FIG. 2.

The cellular communication link 301 is extending between a cellular base station 307 and the OBE. The cellular base station receiving the identification message from the OBE via the cellular communication link 301 can be the same cellular base station transmitting the at least one traffic information message to the OBE via the cellular communication link or another cellular base station depending on the operational conditions of the cellular system used and distances between virtual gantry positions and different cellular base stations.

When the first communication link is a cellular link, reporting of identification is made by transmitting the identification message when predetermined virtual gantry positions are reached. An alternative to this is that the OBE transmits the identification message at a regular schedule, e.g. every third minute, i.e. at a position reached by the OBE-equipped vehicle at a predetermined point of time. In this example a request for identification message is thus not required. Calculation of fees can then be made locally at the OBE or at the station or the main station as described above.

The station can also be a mobile unit, preferably using a DSRC link, and temporarily located at e.g. certain roads where a heavy traffic is expected in association with special events as e.g. exhibitions. A further application, made possible with the invention, is to temporarily locate the mobile unit at e.g. a roadwork in order to inform passing vehicles of the situation. In the latter of these two applications there is no need to transmit an identification message to the station and a positioning function as a GPS receiver is not needed in the OBE.

A further application of the invention when the station is a mobile unit is to operate the station when the station is moving. This can be used e.g. in "enforcement of fee applications" when it is desirable to check the presence and operation of an OBE in a certain vehicle by locating the mobile unit close to the vehicle to be checked. The function of this application otherwise corresponds to the example with a DSRC link described in association with FIG. 2.

The OBE further comprises the Control Unit, CU, 213 having a CU input terminal 214 and a first 215 and a second 216 CU output terminal, see FIGS. 2 and 3. The output terminal 212 of the OBE transmit/receive unit 203 is connected to the CU input terminal 214. The output terminal 212 of the OBE transmit/receive unit is thus the same terminal as the CU input terminal 214. The CU is arranged to convert an output signal from the OBE transmit/receive unit to a format suitable to be transmitted via the second communication link 210. The converted message format is arranged to be available at the first CU output terminal 215.

The second CU output terminal 216 can optionally be connected to a buzzer unit 217 arranged to deliver said traffic information message in a coded form as a series of beeps or different tones. This arrangement can e.g. be used as a back-up system in case the existing audio system is out of service or not in operation.

In one example of the invention the second communication link 210 is a short range FM-radio communication link comprising RDS/RBDS (Radio Data System/Radio Broadcast Data System). An FM radio transmitter 218 is incorporated in the OBE. RBDS is the official name used for the US version of RDS. The RDS is a communication protocol where digital information is integrated in an FM radio broadcast. The FM radio (FM=Frequency Modulation) transmitter comprises an FM input terminal 219 and an FM output terminal 220. The FM input terminal 219 is connected to the first CU output terminal 215 (the first CU output terminal 215 is thus the same terminal as the FM input terminal 219) and the FM output terminal 220 is connected to an FM radio antenna 221 arranged to transmit an FM signal including said traffic information message with integrated digital information from the FM radio antenna 221 via the second wireless communication link 210 to an FM receive antenna 222 at the existing audio system 209. Said receive antenna 222 being connected to an FM receiver of the existing audio system arranged to deliver said traffic information message as a voice message to said speakers 208 through the prioritized channel of the existing audio system 209.

The prioritized channel of the existing audio system is the channel used by the RDS/RBDS system to send traffic information. This means that when a traffic information message is sent from the FM transmitter 218, the RDS/RBDS function will cause the existing audio system to stop the tape, pause the CD or interrupt a tuned radio channel in order to retune the radio receiver to the prioritized channel when the message is received at the existing audio system. When the traffic information message is delivered the existing audio system returns to its previous activity. A prerequisite for this arrangement is of course that the receiver of the existing audio system is equipped also with the RDS/RBDS function.

A suitable frequency for transfer of said traffic information message over the second communication link is selected using existing technology.

Figure 4:
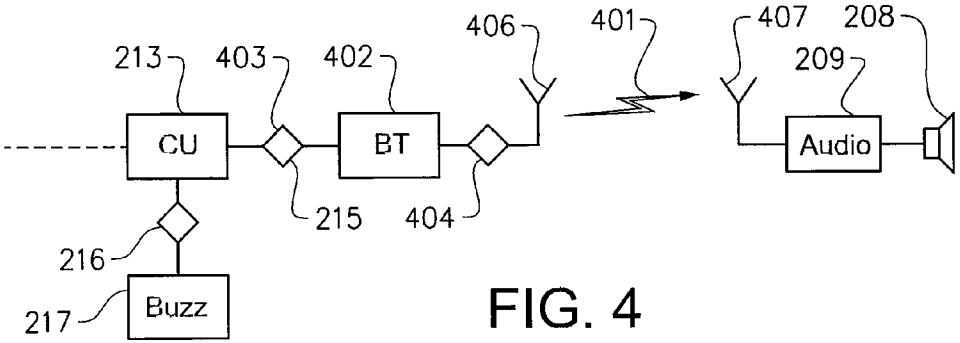
FIG. 4 schematically shows a block diagram of an example of implementation of a second wireless communication link according to the invention.

In a further example of the invention, illustrated in FIG. 4, the second communication link is a Bluetooth communication link 401. A Bluetooth transmitter 402 is incorporated in the OBE. The Bluetooth transmitter comprising a BT (Bluetooth) input terminal 403 and a BT output terminal 404. The BT input terminal 403 is connected to the first CU output terminal 215 of the CU 213. The BT output terminal 404 is connected to a Bluetooth antenna 406 arranged to transmit a Bluetooth signal including said traffic information message from the Bluetooth antenna 406 via the second wireless communication link 401 to a BT receive antenna 407 of the existing audio system 209. Said receive antenna being connected to a Bluetooth receiver of the existing audio system 209 arranged to deliver said traffic information message as a voice message to said speakers 208 through the prioritized channel of the existing audio system. The second CU output terminal 216 is connected to the buzzer 217. In other respects the realization of the OBE of FIG. 4 corresponds to the realizations illustrated in FIG. 2 or 3. In order for a realization of the invention with the second communication link being a Bluetooth link to work, the existing audio system must be equipped also with a Bluetooth receiver having a priority function similar to the RDS function described above. This means that when the existing audio system receives a Bluetooth signal, ongoing activities of the existing audio system is stopped and the message sent with the Bluetooth signal is processed and outputted on said speakers.

Figure 5:
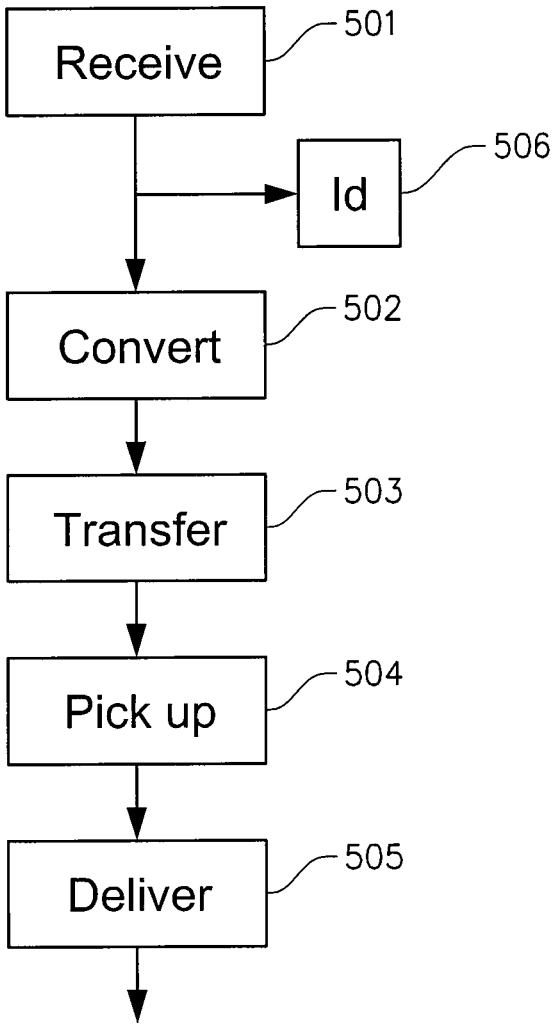
FIG. 5 schematically shows a block diagram of an example of the method of the invention.

The invention also includes a method for transferring a message from a station 204, 307 to a vehicle using an On Board Equipment, OBE 201, mounted on the vehicle. The OBE has an OBE antenna 202 connected to an OBE transmit/receive unit 203 where the method comprises the following steps as schematically illustrated in FIG. 5:

- using the OBE antenna 202 for receiving 501 an RF signal from a station 204, 307 via a first communication link 207, 301, the RF signal comprising at least one traffic information message from the station,
- using the OBE 201 to convert 502 said traffic information message for transfer to an audio output through at least one speaker 208 in an existing audio system 209 of the vehicle, wherein the method further comprises the steps of:

- performing said transfer 503 of the traffic information message to the existing audio system 209 via a second communication link 210, 401,
- picking up 504 said traffic information message by standard receiving means of the existing audio system 209 and
- delivering 505 said traffic information message as a voice message on said speakers 208 through a prioritized channel of the existing audio system.

In one example of the method of the invention the method comprises the additional step 506 of transmitting an identification message from the OBE 201 via the OBE antenna 202, or a separate antenna, and the first communication link 207, 301 to the station 204, 307.

In one example of the method of the invention said traffic information message is sent as an audio file, e.g. as an MP-3 file, on the first communication link. MP-3 stands for MPEG-1 Audio layer 3, and is part of the MPEG-1 standard for compressing of audio files and is well known to the skilled person.

In one example of the method of the invention the OBE 201 uses means for:

- storing predetermined traffic information messages in the OBE, a certain message is transferred to the input terminal 214 of the Control Unit, CU, 213 after receipt of an instruction message from the station 204, 307 via the OBE transmit/receive unit 203, the instruction message defining which message to be sent,
- converting in the CU 213 the predetermined message to a format suitable to be transmitted via the second communication link 210, 401, the converted message format being available at the first CU output terminal 215.

The invention also includes a traffic information system 200, wherein the traffic information system comprises:

- a station 204, 307 comprising the transmit/receive unit 205, 302
- the OBE 201,
- a first wireless communication link 207, 301 between the station and the OBE 201 and
- a second wireless communication link 210, 401, between the OBE 201 and the existing audio system 209 located in the vehicle, arranged for transfer of the traffic information message to the existing audio system 209.

The traffic information system is preferably used in an application as a traffic toll information system where the station is a toll station.

The traffic information message is preferably arranged to be sent as an audio file, e.g. an MP-3 file, on the first communication link. As an alternative the OBE comprises means for storing predetermined traffic information messages in the OBE. A certain instruction message is arranged to be transferred to the input terminal 214 of the CU 213, after receipt of the instruction message from the station 204, 307, via the OBE transmit/receive unit 203. The instruction message defines which predetermined traffic information message to be sent. The CU comprises means to convert the predetermined traffic information message to a format suitable to be transmitted via the second communication link 210, 401. The converted message format is arranged to be available at the first CU output terminal 215.

The systems DSRC, Bluetooth, RDS/RBDS, GPS, GSM, GPRS, EDGE, HSCSD, LTE, 3G and 4G mentioned in the description are well known to the skilled person and therefore here not further explained or discussed.

A station can thus e.g. be:

- a stationary station 204 with at least one colocated gantry arranged for using a short range link as e.g. a DSRC link as the first communication link 207 and arranged for receiving identification messages when the OBE-equipped vehicle passes the station or
- a stationary station 307 arranged for using a cellular link as the first communication link 301 and arranged for receiving identification messages when virtual gantry positions, corresponding to predetermined positions, are reached by OBE-equipped vehicles or
- a stationary station 307 arranged for using a cellular link as the first communication link 301 and arranged for receiving identification messages at positions reached by the OBE-equipped vehicle at predetermined points of time or
- a mobile station 204 temporarily located at a certain position, or arranged for operation being in motion, and otherwise functioning as a stationary station with a colocated gantry.

The invention also includes a traffic information system where the station comprises either one of the above mentioned types of stations. A station always comprises a transmit/receive unit with associated antenna.

Radio Frequency (RF) is a frequency of electromagnetic radiation below around 300 GHz, i.e. it includes e.g. frequencies for radio, TV and all kinds of radio communication such as FM radio, Bluetooth, GSM and 3G.

The first and second communication links are wireless communication links as described and the signal received at the OBE antenna from the station via the first communication link is preferably an RF signal as described.

The invention is not limited to the embodiments and examples described above, but may vary freely within the scope of the amended claims.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

The invention claimed is:

1. An On Board Equipment, OBE, suitable for mounting on a vehicle, the OBE comprising:

an OBE antenna connected to an OBE transmit/receive unit, the OBE antenna being arranged to receive a signal from a station via a first wireless communication link, the signal comprising at least one traffic information message from the station;

a buzzer unit; and a control unit, CU, having a CU input terminal, a first CU output terminal, and a second CU output terminal, an output terminal of the OBE transmit/receive unit being connected to the CU input terminal;

the CU being arranged to convert the traffic information message for transfer, through the first CU output terminal, to an audio output through at least one speaker in an existing audio system of the vehicle, wherein said transfer of the traffic information message to the existing audio system is arranged to be performed via a second wireless communication link where the traffic information message is arranged to be picked up by standard receiving means of the existing audio system and to be delivered as a voice message on said speakers through a prioritized channel of the existing audio system;

the CU being arranged to convert the traffic information message for transfer, through the second CU output terminal, as a buzzer coded signal to the buzzer unit as a second form of notification or when the existing audio system is in a non-operational state.

2. The OBE according to claim 1, wherein the OBE transmit/receive unit comprises an OBE antenna terminal connected to the OBE antenna, and wherein an identification message, comprising an identification of the vehicle, is arranged to be transmitted from the OBE via the first wireless communication link to the station.

3. The OBE according to claim 2, wherein the first wireless communication link is a Dedicated Short Range Communication, DSRC, link with a DSRC transmit/receive unit as the transmit/receive unit at the station and with a further DSRC transmit/receive unit as the OBE transmit/receive unit, the DSRC transmit/receive unit at the OBE being arranged to receive the signal from the OBE antenna and arranged to transmit the identification message via the first wireless communication link to the station when the OBE-equipped vehicle passes the station.

4. The OBE according to claim 2, wherein the first wireless communication link is a cellular communication link with a cellular transmit/receive unit at the station and the OBE transmit/receive unit comprises a cellular transmit/receive unit arranged to receive the signal from the OBE antenna, the station being a cellular base station, and the OBE further comprises a GPS receiver and the OBE is arranged to transmit the identification message via the first wireless communication link to the station when a predetermined position is reached by the OBE-equipped vehicle or at a position reached by the OBE-equipped vehicle at a predetermined point of time.

5. The OBE according to claim 1, wherein the buzzer coded signal comprises a series of beeps.

6. The OBE according to claim 1, wherein the buzzer coded signal comprises a series of different tones.

7. The OBE according to claim 1, wherein the second wireless communication link is a short range Frequency Modulated, FM-radio, communication link comprising Radio Data System/Radio Broadcast Data System, RDS/RBDS, and that an FM radio transmitter is incorporated in the OBE, the FM radio transmitter comprising an FM input terminal and an FM output terminal, the FM input terminal being connected to the first CU output terminal and the FM output terminal being connected to an FM radio antenna arranged to transmit an FM signal including said traffic information message with integrated digital information from the FM radio antenna via the second wireless communication link to an FM receive antenna at the existing audio system, said receive antenna being connected to an FM receiver of the existing audio system arranged to deliver said traffic information message as a voice message to said speakers through the prioritized channel of the existing audio system.

8. The OBE according to claim 1 wherein the second wireless communication link is a Bluetooth communication link and a Bluetooth transmitter is incorporated in the OBE, the Bluetooth transmitter comprising a BT, Bluetooth, input terminal and a BT output terminal, the BT input terminal being connected to the first CU output terminal and the BT output terminal being connected to a Bluetooth antenna arranged to transmit a Bluetooth signal including said traffic information message from the Bluetooth antenna via the second wireless communication link to a BT receive antenna of the existing audio system, said receive antenna being connected to a Bluetooth receiver of the existing audio system arranged to deliver said traffic information message as a voice message to said speakers through the prioritized channel of the existing audio system.

9. The OBE according claim 1, wherein said traffic information message is arranged to be sent as an audio file on the first wireless communication link.

10. The OBE according claim 1, wherein the OBE comprises means for storing predetermined traffic information messages in the OBE, a certain instruction message is arranged to be transferred to the input terminal of the CU, after receipt of the instruction message from the station, via the OBE transmit/receive unit, the instruction message defining which predetermined traffic information message to be sent, the CU comprising means to convert the predetermined traffic information message to a format suitable to be transmitted via the second wireless communication link, the converted message format being arranged to be available at the first CU output terminal.

11. A method for transferring a message from a station to a vehicle using an On Board Equipment, OBE, mounted on the vehicle, the OBE having an OBE antenna connected to an OBE transmit/receive unit where the method comprises the steps of:

using the OBE antenna for receiving a signal from a station via a first wireless communication link the signal comprising at least one traffic information message from the station, using the OBE to convert said traffic information message for transfer from a first OBE output to an audio output through at least one speaker in an existing audio system of the vehicle, performing said transfer of the traffic information message to the existing audio system via a second wireless communication link, picking up said traffic information message by standard receiving means of the existing audio system, delivering said traffic information message as a voice message on said speakers through a prioritized channel of the existing audio system, using the OBE to convert said traffic information message for transfer from a second OBE output to a buzzer unit, transferring said traffic information message to said buzzer unit, and delivering said traffic information message as a coded buzzer signal through said buzzer unit.

12. The method according to claim 11 further comprising the step of transmitting an identification message from the OBE via the first wireless communication link to the station.

13. The method according to claim 11, wherein said traffic information message is sent as an audio file.

14. The method according to claim 12, wherein the OBE uses means for:

storing predetermined traffic information messages in the OBE, a certain message is transferred to the input terminal of a Control Unit, CU, after receipt of an instruction message from the station via the OBE transmit/receive unit, the instruction message defining which message to be sent, converting in the CU the predetermined message to a format suitable to be transmitted via the second wireless communication link, the converted message format being available at the first CU output terminal.

15. A traffic information system comprising:

a station comprising a transmit/receive unit, the OBE according to claim 1, a first wireless communication link between the station and the OBE, and a second wireless communication link between the OBE and the existing audio system located in the vehicle and arranged for transfer of the traffic information message to the existing audio system.

16. The traffic information system according to claim 15, wherein the station is one of:

a stationary station with at least one colocated gantry arranged for using a short range link as the first wireless communication link and for receiving identification messages when the OBE-equipped vehicle passes the station; or a stationary station arranged for using a cellular link as the first wireless communication link and for receiving identification messages when virtual gantry positions, corresponding to predetermined positions, are reached by OBE-equipped vehicles; or a stationary station arranged for using a cellular link as the first wireless communication link and for receiving identification messages at positions reached by the OBE-equipped vehicle at predetermined points of time; or a mobile station temporarily located at a certain position, or arranged for operation being in motion.

* * * * *